United States Patent [19]

Aach et al.

[11] Patent Number: 4,596,055

[45] Date of Patent: Jun. 24, 1986

[54] ADJUSTABLE WAIST GARMENT

[75] Inventors: Allyn J. Aach; Arturo A. Carnaghi, both of St. Louis County, Mo.

[73] Assignee: Angelica Corporation, St. Louis, Mo.

[21] Appl. No.: 764,187

[22] Filed: Aug. 9, 1985

[51] Int. Cl.[4] ..... A41F 9/02

[52] U.S. Cl. ..... 2/237

[58] Field of Search ..... 2/237, 221, 236, 220, 2/76

[56] References Cited

U.S. PATENT DOCUMENTS

| | | | |
|---|---|---|---|
| 2,749,556 | 6/1956 | Lampkowitz | 2/237 |
| 3,839,740 | 10/1974 | Tornberg | 2/237 |
| 4,193,136 | 3/1980 | Pierce | 2/237 |

*Primary Examiner*—Louis K. Rimrodt

*Attorney, Agent, or Firm*—Rey Eilers

[57] ABSTRACT

The present invention provides a garment which can have the waist size thereof adjusted quickly, and yet is a garment which can withstand (a) the strong washing and cleaning solutions and (b) the rigorous washing and cleaning procedures used by linen suppliers. That waist adjusting arrangement includes a masking band and a confining and guiding arrangement for a portion of that band. That confining and guiding arrangement is disposed at the inner face of one of the side panels of the garment; and that masking band is secured to the other of those side panels. That masking band will prevent unlimited separation of those side panels, and a portion of that masking band will overlie and conceal any fasteners which are not overlain and concealed by the one side panel whenever the garment is given its largest waist size.

29 Claims, 13 Drawing Figures

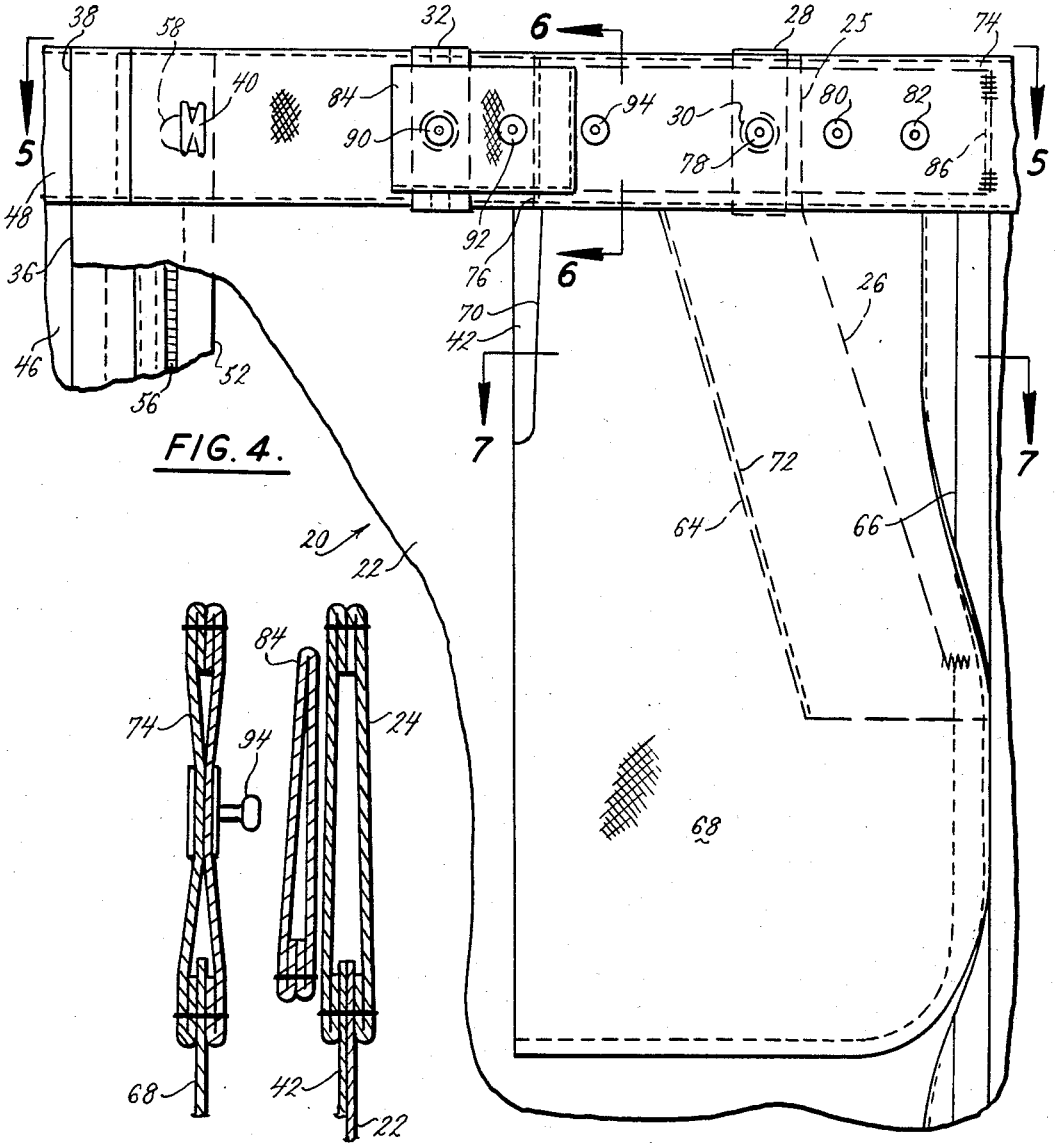
FIG. 4.
FIG. 6.
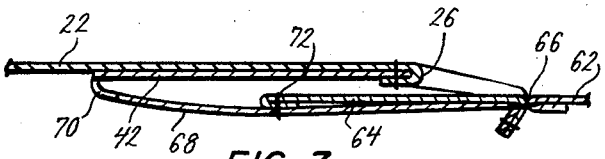
FIG. 7.
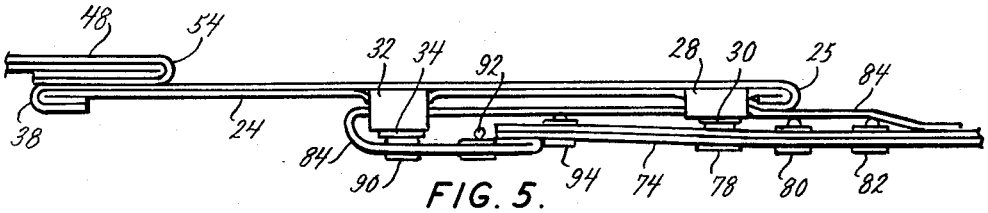
FIG. 5.

ADJUSTABLE WAIST GARMENT

SUMMARY OF THE INVENTION

Many companies, which supply the work clothes that are worn by their employees, rent those work clothes from linen suppliers; and those linen suppliers periodically collect those work clothes, clean them, and then re-supply them to those businesses for further wearing. Because the waist sizes of employees can vary considerably, the linen suppliers frequently have to maintain large inventories of garments with different waist sizes. It would be desirable to provide a garment which could have the waist size thereof adjusted quickly, and yet would be a garment which could withstand the rigors and wear and tear of use in greasy, abrasive and dirty work areas, and also could withstand (a) the strong washing and cleaning solutions and (b) the rigorous washing and cleaning procedures used by linen suppliers. Also, it would be desirable that no fasteners of the waist adjusting arrangement of such a garment be exposed at the outer surface of that garment, thereby (a) minimizing the risk of that waist adjusting arrangement snagging or being snagged by objects with which the employees must work and (b) providing an attractive appearance for that garment. In addition, it would be desirable for the waist adjusting arrangement of that garment to provide a limited amount of automatic waist expansion in the event the wearer took an unusually deep breath, coughed heavily, sneezed heavily, over indulged at mealtime, or otherwise experienced a small increase in waist size while wearing the garment. The present invention provides such a garment; and it is, therefore, an object of the present invention to provide a garment which can have the waist size thereof adjusted quickly, which can withstand the rigors and wear and tear of use in greasy, abrasive and dirty work areas, and also withstand the strong washing and cleaning solutions and the rigorous washing and cleaning procedures used by linen suppliers, which has no fasteners of the waist adjusting arrangement thereof exposed at the outer surface of that garment, and which can provide a limited amount of automatic waist expansion in the event the wearer's waist size increases while that garment is being worn.

The waist adjusting arrangement provided by the present invention secures the upper part of the front side panel to the upper part of the rear side panel of the garment by a plurality of laterally-spaced fasteners which are selectively securable to correspondingly-spaced complementary fasteners. By providing the plurality of fasteners and by providing the complementary fasteners, the present invention keeps any strain, which might be applied to the waist adjusting arrangement, from being concentrated at just one fastener and at just one complementary fastener. The plurality of fasteners and the complementary fasteners would automatically distribute any such strain between themselves, and would thereby free the garment from unsightly stress points. Also, the plurality of fasteners and the complementary fasteners provide a desirable safety factor, in the event the wearer failed to secure one of the fasteners or "popped" one of the fasteners while wearing the garment. It is, therefore, an object of the present invention to provide a waist adjusting arrangement for a garment wherein a plurality of laterally-spaced fasteners are selectively securable to complementary fasteners.

The waist adjusting arrangement provided by the present invention permits the upper part of the front side panel and the upper part of the rear side panel to be fold-free in each adjusted position of those side panels. Also, that waist adjusting arrangement permits those upper parts to be free of gathers and puckers in each adjusted position of those side panels. As a result, that waist adjusting arrangement enables the garment to have a smooth, comfortable, and natural appearance. It is, therefore, an object of the present invention to provide a waist adjusting arrangement for a garment wherein the upper part of the front side panel and the upper part of the rear side panel are fold-free, and also are free of gathers and puckers, in each adjustable position of those side panels.

The waist adjusting arrangement provided by the present invention includes a masking band and a confining and guiding arrangement to hold a portion of that band. That confining and guiding arrangement is disposed at the inner face of one of the side panels of the garment; and that masking band is secured to the other of those side panels. That masking band gives the appearance of being a part of each of the waistbands of the two side panels; and the portion of that masking band which is held by the confining and guiding arrangement will prevent unlimited separation of those waistbands, while a further portion of that masking band will overlie and conceal any of the complementary fasteners which are not overlain and concealed by the one side panel whenever the garment is given its largest waist size. As a result, the masking band tends to make the garment look like a conventional garment which has a waistband, it keeps each side panel from pulling away from the other side panel in an unsightly manner, and it conceals any complementary fastener which might otherwise be exposed at the surface of the garment. It is, therefore, an object of the present invention to provide a waist adjusting arrangement for a garment which includes a masking band on one side panel of that garment and also includes a confining and guiding arrangement at the inner face of the other side panel of that garment to hold a portion of that masking band.

The fasteners which are provided by the present invention have portions thereof secured to the inner face of the confining and guiding arrangement; and that arrangement has a limited amount of "give" or lateral yieldability. As a result, that arrangement can enable the fasteners, which are secured to it, to shift laterally a short distance and thereby slightly enlarge the waist size of the garment. Consequently, that arrangement enables the garment to automatically compensate for small increases in the waist size of the wearer while the wearer is wearing that garment. It is, therefore, an object of the present invention to secure the fasteners of an adjustable waist garment to the inner face of a confining and guiding arrangement which has a limited amount of "give" or lateral yieldability.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing.

FIG. 4 is an elevational view of the interior of the upper right-hand side of the pair of trousers of FIGS. 1 and 2;

FIG. 5 is a plan view of the portion of the pair of trousers which is shown in FIG. 4, and it is taken along a plane indicated by the line 5—5 in FIG. 4;

FIG. 6 is a sectional view, on the scale of FIG. 2, which is taken along a plane indicated by the line 6—6 in FIG. 4;

FIG. 7 is a sectional view, on the scale of FIG. 2, which is taken along a plane indicated by the line 7—7 in FIG. 4;

DETAILED DESCRIPTION OF PREFERRED EMBODIMENT

Figure 3:
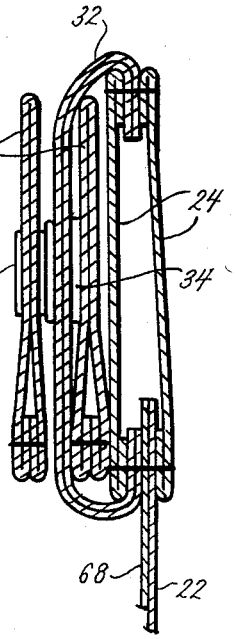
FIG. 3 is a sectional view, on a larger scale, which is taken along a plane indicated by the line 3—3 in FIG. 1.

Referring to the drawing in detail, the numeral 20 generally denotes a pair of trousers in which the principles and teachings of the present invention have been incorporated. The numeral 22 denotes the right side front panel of that pair of trousers; and an external waistband 24 is secured to the top of that panel. The numeral 25 denotes the rear edge of that waistband, and the numeral 26 denotes the free rear edge of that panel. That free rear edge constitutes the outer side of the entrance to the right-hand front pocket of the pair of trousers 20. The waistband 24 has an outer ply and an inner ply; and the top and bottom edges of those plies are folded inwardly and held by stitching—all as shown by FIG. 3.

The numeral 28 denotes a guiding and confining loop which is provided at the interior of the waistband 24 adjacent the rear edge 25 of that waistband. The numeral 32 denotes a further guiding and confining loop which is provided at the interior of the waistband 24; and that loop is intermediate the loop 28 and the front edge 38 of that waistband. As shown particularly by FIG. 3, the loop 32 is a two-ply loop; and the upper and lower ends thereof are sewn between the upper and lower edges of the plies of the waistband 24. The loop 28 preferably is identical to the loop 32; and preferably is secured to the waistband 24 in the same way. A female snap fastener 30 is secured to the approximate midpoint of the vertical portion of the loop 28; and that snap fastener opens inwardly toward the wearer of the pair of trousers. A similar female snap fastener 34 is secured to the approximate midpoint of the vertical portion of the loop 32; and that snap fastener also opens inwardly toward the wearer of the pair of trousers.

Figure 1:
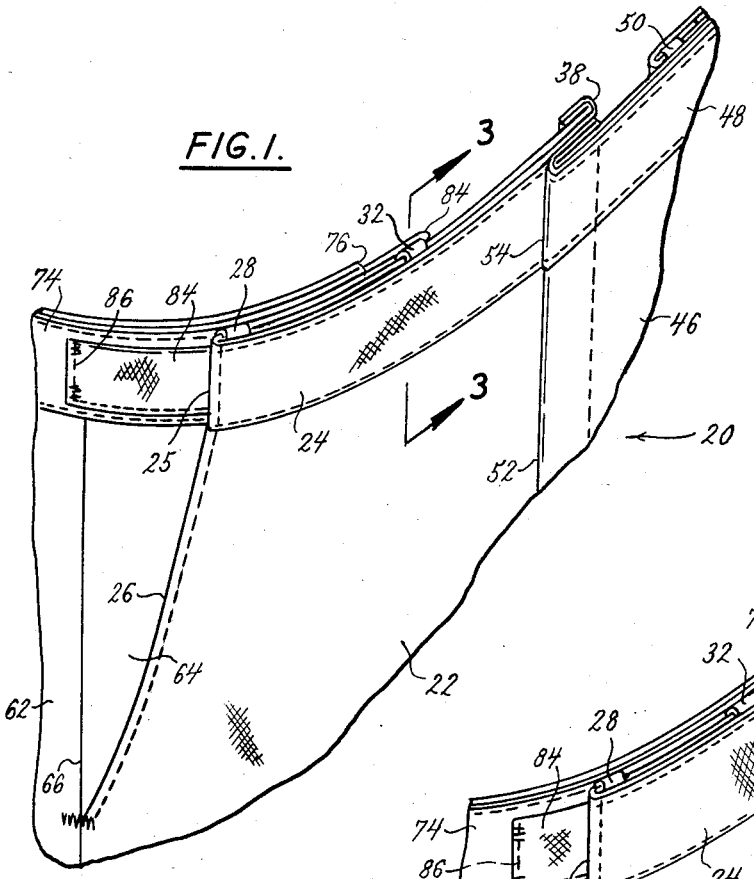
FIG. 1 is a perspective view of the right-hand portion of the upper part of a pair of trousers in which the principles and teachings of the present invention have been incorporated.
Figure 8:
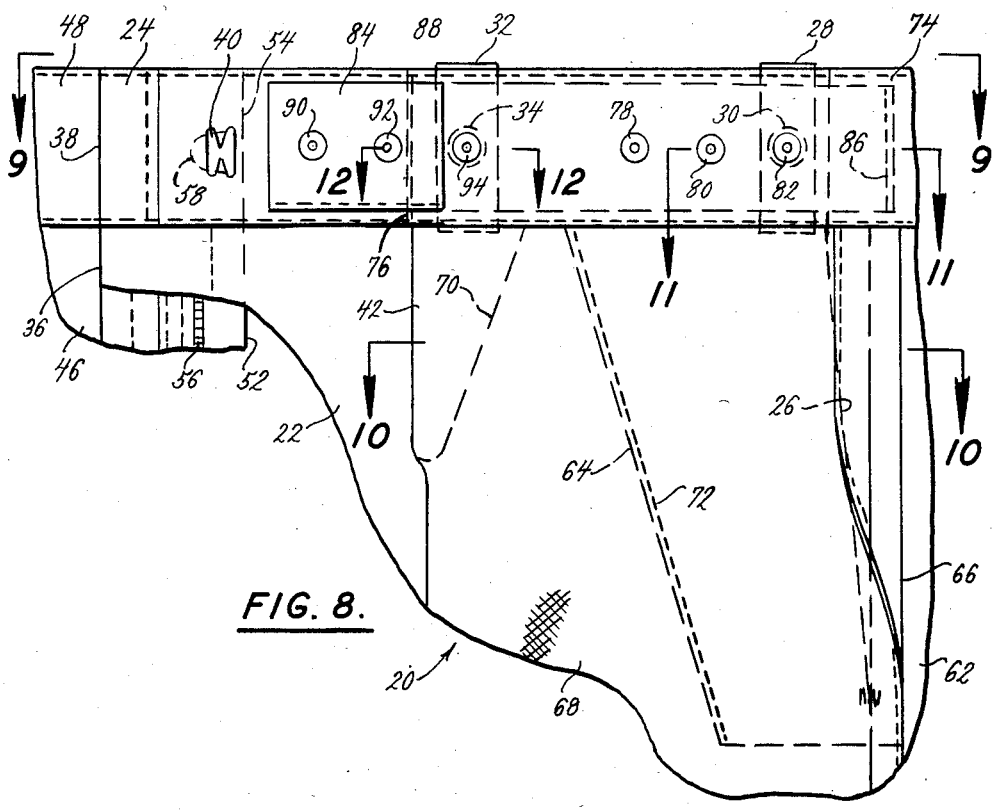
FIG. 8 is another elevational view of the interior of the upper right-hand side of the pair of trousers of FIGS. 1 and 2, but it shows that pair of trousers in its minimum waist size position.

The numeral 36 denotes the front edge of the panel 22, as shown particularly by FIGS. 4 and 8; and that front edge is essentially aligned with the front edge 38 of the waistband 24. Both of those front edges are folded and seamed to provide a finished appearance for the center of the front of the pair of trousers 20. A fastener 40, of standard and usual design, is carried by the waistband 24 adjacent the front edge 38 of that waistband; and that fastener is shown in FIGS. 4 and 8. That fastener is intended to help hold the right side front panel 22 against undesired separation from the left side front panel 46 of the pair of trousers. The top of that left side front panel has an external waistband 48 with a front edge 54. That front edge, and the front edge 52 of the left side front panel 46, are folded and seamed to help provide the finished appearance for the center of the front of the pair of trousers 20. A guiding and confining loop 50, which is indicated by FIG. 1, is sewn into the waistband 48. That guiding and confining loop will be comparable to, and will perform functions that are similar to the functions performed by, the confining and guiding loop 32. The numeral 58 denotes an arcuate fastener, of standard and usual design, which is carried by the waistband 48 adjacent the free end of that waistband; and that fastener is indicated by dotted lines in FIGS. 4 and 8. That fastener will coact with the fastener 40 to hold the front panels of the pair of trousers together until the zipper can be closed. A portion of one half of that zipper is shown in FIGS. 4 and 8, it is denoted by the numeral 56, and it is of standard and usual construction.

Belt loops have not been shown in the drawing, because a showing of such loops could tend to obscure the showing of the present invention. However, if desired, the pair of trousers 20 could be provided with belt loops of any desired design and construction. Alternatively, that pair of trousers could be provided with buttons to receive the lower ends of suspenders.

Figure 10:
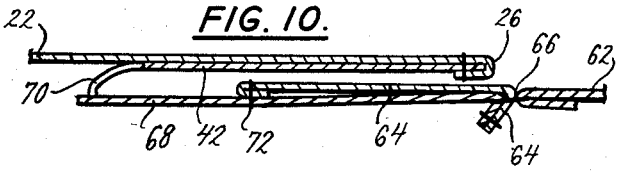
FIG. 10 is a sectional view, on the scale of FIG. 8, which is taken along a plane indicated by the line 10—10 in FIG. 8.

The numeral 42 denotes the outer wall of the right-hand front pocket of the pair of trousers, as shown by FIGS. 7 and 10. The top of that wall and the top of the panel 22 are stitched between the lower edges of the plies of the waistband 24, as shown particularly by FIGS. 3 and 6. The upper rear edge of the wall 42 is held by the seam at the free rear edge 26 of the panel 22. The lower rear edge of that wall is held by a seam 66 which secures the right side front panel to the right side rear panel 62. The pocket has a generally rectangular configuration, as shown particularly by FIG. 4.

The panel 62 has a generally-triangular extension 64 adjacent the upper end of the front edge thereof; and that extension is disposed inwardly of the upper rear portion of the right side front panel 22, as shown by FIGS. 7 and 10. That generally-triangular extension serves as the inner side of the entrance to the right-hand front pocket; and it also constitutes a part of the inner wall of that pocket. The numeral 68 denotes the major part of the inner wall of the pocket; and that wall and the outer wall 42 are preferably made by folding a piece of fabric. The numeral 70 denotes a cut-away portion at the upper part of the folded front edge of the pocket. The numeral 72 in FIGS. 4 and 8 denotes a line of stitches which secures the front edge of the generally-triangular extension 64 to the inner wall 68 of the pocket.

The numeral 74 denotes an external waistband adjacent the top of the panel 62; and that waistband preferably has the same shape, dimensions, fabric and color as the waistband 24. The front edge of waistband 74 is denoted by the numeral 76; and that front edge, and the forward portion of the length of that waistband, are disposed inwardly of the waistband 24.

Figure 2:
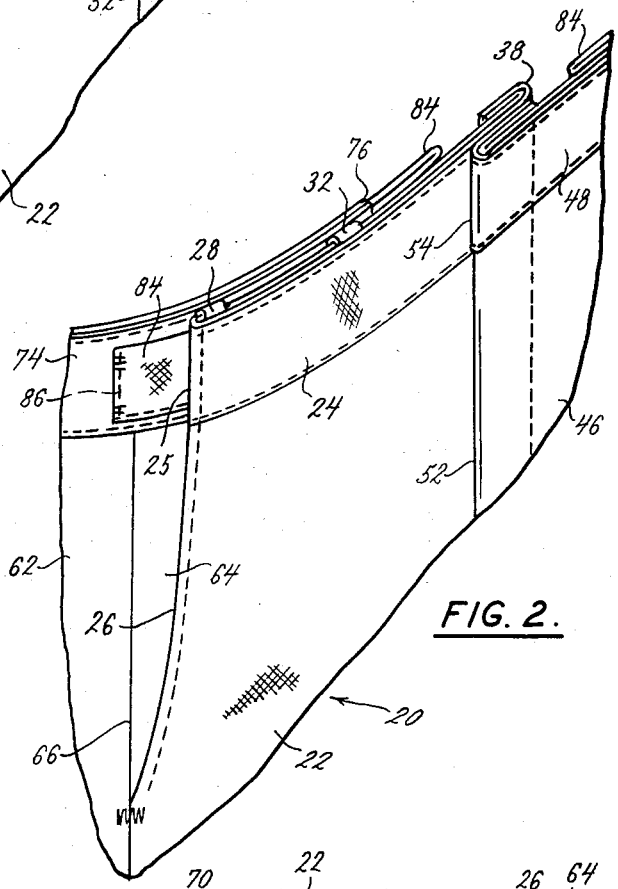
FIG. 2 is a further perspective view of that upper part which shows the pair of trousers in its minimum waist size position.

The numerals 78, 80 and 82 denote male snap fasteners which are carried by the waistband 74; and those fasteners face away from the wearer of the pair of trousers 20. Those male fasteners are complementary to the female snap fastener 30 which is carried by the confining and guiding loop 28, and vice versa. The numeral 84 denotes a masking band which preferably has the same shape, fabric and color as the waistbands 24 and 74. However, that masking band has a shorter vertical dimension than do those waistbands, as indicated particularly by FIGS. 1 and 2. Stitching 86 secures one end of the masking band 84 to the outer face of the waistband 74 at a point which is displaced several inches from the forward end 76 of that waistband. Stitching 88 secures the other end of the masking band 84 to the inner face of the waistband 74 immediately adjacent the front edge 76 of that waistband, as shown particularly by FIGS. 4 and 8. A male snap fastener 90 is carried by the portion of masking band 84 which is adjacent the stitching 88. Male fasteners 92 and 94 are carried by the forward end of the waistband 74; and all of the snap fasteners 90, 92 and 94 face away from the wearer of the pair of trousers, as shown particularly by FIGS. 5 and 9. Those male fasteners are complementary to the female snap fasteners 34 which is carried by the guiding and confining loop 32, and vice versa.

Figure 9:
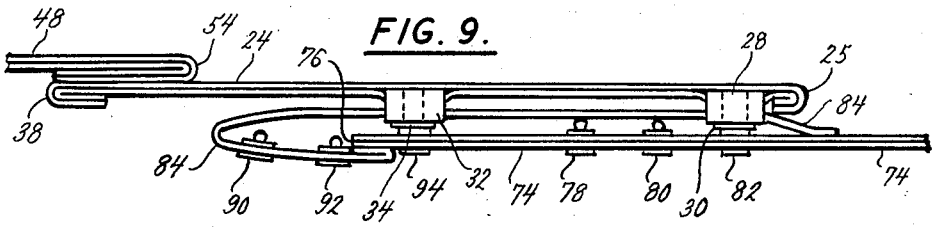
FIG. 9 is a plan view of the portion of the pair of trousers which is shown in FIG. 8, and it is taken along a plane indicated by the line 9—9 in FIG. 8.
Figure 12:
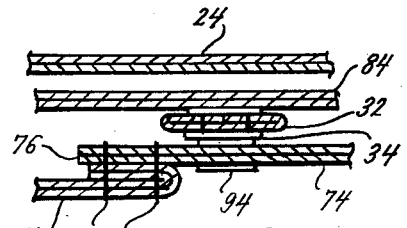
FIG. 12 is a sectional view, on the scale of FIG. 11, which is taken along a plane indicated by the line 12—12 in FIG. 8.
Figure 11:
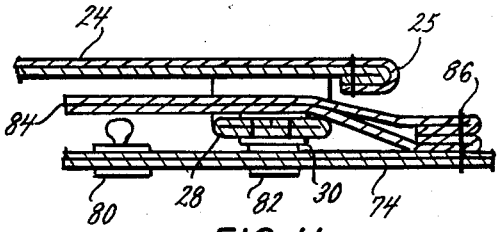
FIG. 11 is a sectional view, on a larger scale, which is taken along a plane indicated by the line 11—11 in FIG. 8.

When the pair of trousers 20 is to be worn by a person having a large waist size, the snap fasteners 34 and 90 will be in engagement and the snap fasteners 30 and 78 will be in engagement, as shown by FIG. 5. For a person with a small waist size, the snap fasteners 34 and 94 will be in engagement and the snap fasteners 30 and 82 will be in engagement, as shown by FIG. 9. For a person with an intermediate waist size, the snap fasteners 34 and 92 will be in engagement and the snap fasteners 30 and 80 will be in engagement.

A waist adjusting arrangement, which is a mirror image of the waist-adjusting arrangement shown in the drawing, is provided at the left-hand side of the pair of trousers 20. The loop 50, which is indicated by FIG. 1, is a part of that mirror image waist-adjusting arrangement. The male fasteners 78, 80 and 82 and the male fasteners 90, 92 and 94 are preferably so spaced that they can provide waist size adjustments which correspond to one-half of even-numbered waist size adjustments; and the other half of those waist size adjustments can be provided by the waist-adjusting arrangement at the left-hand side of the pair of trousers 20. Specifically, the male fasteners 78, 80 and 82 and the male fasteners 90, 92 and 94 preferably are spaced so they can provide one-half of the waist size adjustments which would be needed to make the pair of trousers 20 a "size 32", a "size 34" or a "size 36".

It should be noted that by having waist-adjusting arrangements at each side of the pair of trousers 20, it is possible to provide odd numbered, as well as even numbered, adjustments in the waist size of that pair of trousers. For example, if an odd numbered waist size was desired, the male fasteners of the left-side waist-adjusting arrangement, which correspond to the male fasteners 82 and 94, could be secured to the female fasteners of that waist-adjusting arrangement, while the male fasteners 80 and 92 were secured to the female fasteners 30 and 34. Similarly, the male fasteners of the left-side waist-adjusting arrangement, which correspond to the male fasteners 80 and 92 could be secured to the female fasteners of that waist-adjusting arrangement, while the male fasteners 78 and 90 were secured to the female fasteners 30 and 34. By using all of the possible combinations of male and female fasteners at the two sides of the pair of trousers 20, it is possible to make that pair of trousers fit persons having waist sizes throughout a five (5) inch range. As a result, a linen supplier can substantially reduce its inventory of pairs of trousers by using pairs of trousers which utilize the principles and teachings of the present invention. Also, persons who experience substantial changes in their waist sizes can avoid the purchasing of pairs of trousers of different waist sizes by using pairs of trousers which utilize the principles and teachings of the present invention.

The masking band 84 will have the major portion of the length thereof passed through the loops 28 and 32 before the stitches 86 or the stitches 88 are formed. Those loops will be made large enough to permit sliding movement of that masking band through the spaces between the vertical portions of those loops and the confronting portions of the waistband 24; but those loops will be made small enough to enable those confronting portions to provide frictional forces which will tend to hold that masking band in any adjusted position in which it is placed. Also, those loops will be made small enough to hold the major portion of the length of that masking band in close, face-to-face engagement with the inner face of waistband 24. As a result, that waistband, that masking band, the loops 28 and 32, and the waistband 74 will have a combined thickness which is far smaller than any of the combined thicknesses that are indicated on the drawing for those components of the waist adjusting arrangement.

Whenever the pair of trousers 20 is providing its maximum waist size, as shown by FIG. 5, the engagement between male fastener 90 and female fastener 34 and the engagement between male fastener 78 and female fastener 30 will hold the forward areas of waistband 74 and of the upper part of panel 62 close to the inner faces of waistband 24 and of the upper part of panel 22. Also the loop 32 will hold the reentrant bend, at the front of the masking band 84, close to the waistband 24. Whenever that pair of trousers is providing its minimum waist size, as shown by FIG. 9, the engagement between male fastener 94 and female fastener 34 and the engagement between male fastener 82 and female fastener 30 will hold the forward areas of waistband 74 and of the upper part of panel 62 close to the inner faces of waistband 24 and of the upper part of panel 22. The reentrant bend in the masking band 84 will be disposed forwardly of the loop 32, but the fabric in that masking band will have sufficient "body" to tend to hold that reentrant bend close to the inner face of waistband 24.

By securing the female snap fasteners 30 and 34 to the vertical portions of the loops 28 and 32, rather than directly to the waistband 24, the present invention completely frees the exterior of that waistband from all portions of those female fasteners. As a result, those female fasteners will be completely concealed by that waistband and by the masking band 84. Moreover, by mounting those female fasteners adjacent the midpoints of the vertical portions of those loops, the present invention enables those female fasteners to move laterally as those vertical portions yield in the lateral direction in response to the application of heavier-than-normal, circumferentially-directed forces to the waistbands of the pair of trousers. That lateral yielding of those vertical portions of those loops will provide a small amount of "give" to the waistbands of the pair of trousers 20, in the event the wearer of that pair of trousers coughs heavily, sneezes heavily, overeats, or otherwise expands his or her waist size while wearing that pair of trousers.

Whenever the pair of trousers 20 has its largest waist size, the male fastener 82 and part of the male fastener 80 will not be overlain and concealed by the waistband 24, as shown by FIG. 5. However, those fasteners will be overlain and concealed by the rear portion of the masking band 84. Also, that masking band will extend from a point, which is rearward of the side seam 66, to the rear edge 25 of waistband 24, and will then pass inwardly of that waistband. As a result, that masking band will seem, from even short distances, to be an integral part of both waistbands 24 and 74.

Although the upper portion of the rear edge 26 of the panel 22 will be disposed an appreciable distance forwardly of the side seam 66, as shown particularly by FIG. 7, the generally-triangular extension 64 will extend even further forwardly. That extension will be of the same fabric, and will have the same color, as the panel 62; and hence it will harmonize with the panel 22 in the largest waist size position as well as in the smallest waist size position of the pair of trousers 20. The cutaway portion 70, at the upper part of the folded edge of the right-hand front pocket of the pair of trousers, will permit the panel 22 to be moved as far forwardly and as far rearwardly, relative to the panel 62 and its extension 64, as is required for any desired waist size adjustment.

Whenever the pair of trousers 20 has its smallest waist size, both of the male fasteners 80 and 82 will be overlain and concealed by the waistband 24 as well as by the masking band 84, as shown by FIG. 9. Again, that masking band will seem, from even short distances, to be an integral part of both of the waistbands 24 and 74. The rear edge 25 of waistband 24 will be disposed close to the rear portion of masking band 84, and the upper portion of the rear edge 26 of the panel 22 will be relatively close to the side seam 66, as shown particularly by FIG. 2. As a result, the pair of trousers 20 will have the appearance of a pair of trousers with a continuous waistband.

Whenever the waistbands 24 and 74 are in the smallest-waist-size position of FIG. 9, the reentrant bend in the front of the masking band 84 will be spaced an appreciable distance forwardly of the loop 32. To cause that reentrant bend to lie immediately adjacent the inner surface of the waistband 24, and to cause the major portion of that masking band to be free of folds, gathers or puckers and to lie essentially flat against that inner surface, the wearer of the pair of trousers 20 need only extend a thumb or finger inwardly of that reentrant bend and move it in the circumferential direction toward the forward end 38 of waistband 24. The wearer can do that as he or she is moving the forward edges of the panels 22 and 46 toward each other, or can insert that thumb or finger after the fasteners 40 and 58 have been engaged to hold the front of the pair of trousers in closed position. The reentrant bend of the masking band for the waist adjusting arrangement at the left-hand side of the pair of trousers can be moved forwardly in the circumferential direction simultaneously with, before, or after the reentrant bend of masking band 84 is moved forwardly. In each instance, the reentrant bend of each masking band will lie immediately adjacent the inner surface of the adjacent waistband, and the portion of that masking band which is held by the loops will be free of folds, gathers and puckers and will lie essentially flat against that inner surface.

As shown particularly by FIGS. 5 and 7, the waistbands 24 and 74 and the panels 22 and 62 are free of folds, gathers and puckers whenever the pair of trousers 20 has its largest waist size. Also, the masking band 84 is free of gathers and puckers, and that desirable result is attained automatically by the interaction of loop 32 with the reentrant bend in the masking band 84. FIGS. 9-12 show that even when that pair of trousers has its smallest waist size, the waistbands 24 and 74 and the panels 22 and 62 are free of folds, gathers and puckers. Again, the masking band 84 is free of gathers and puckers, and that desirable result is attained by applying a forwardly-directed, circumferential force to the reentrant bend in the masking band 84. Those waistbands and those panels also are free of folds, gathers and puckers, and that masking band can be free of gathers and puckers in each of the three intermediate waist sizes which can be provided by the waist adjusting arrangements at the two sides of that pair of trousers. Similarly, the corresponding waistbands and panels of the waist adjusting arrangement at the left-hand side of the pair of trousers will be free of folds, gathers and puckers, and the masking band of that waist adjusting arrangement can be free of gathers and puckers in all adjusted waist sizes of that pair of trousers. As a result, the pair of trousers 20 can provide a smooth and natural appearance when worn by wearers of several different waist sizes.

A number of the views of the drawings are pseudo-exploded in form to facilitate a clear showing of the structure of the waist adjusting arrangement provided by the present invention. In particular, the section of FIG. 6 is in pseudo-exploded form; and the loop 32 which is disposed to the left of the line 6-6 in FIG. 4 has not been shown in FIG. 6. In an actual garment, the major portions of the inner faces of the plies of the waistband 24 abut each other, the major portions of the inner faces of the plies of the masking band 84 abut each other, the outer face of that masking band abuts the inner face of that waistband, the inner faces of loops 28 and 32 abut the inner face of that masking band, and the outer face of waistband 74 will lie as close to the inner face of that masking band and to the inner face of waistband 24 as the snap fasteners will permit. The overall result is that the combined thicknesses of the lapped portions of waistbands 24 and 74 and of the masking band 84 are just a small fraction of an inch.

Where the masking band 84 is made of the same fabric of which the waistbands 24 and 74 is made, and where that masking band has the same color as those waistbands, that masking band appears, from even just a short distance away, to be an integral part of one continuous waistband for the pair of trousers. As a result, the external appearance of the pair of trousers 20 can be essentially the same as the external appearance of a pair of trousers which has a fixed waist size and which is provided with a continuous waistband.

The connecting of both ends of the masking band 84 to the waistband 74 coacts with the holding of the major portion of the length of that masking band by the guiding and confining loops 28 and 32 to (a) limit the extent to which the adjacent ends of the waistbands 24 and 74 can move away from each other and (b) limit the extent to which the area of the upper part of the front of the panel 62 can move away from the area of the upper part of the rear of the panel 22, and vice versa. As a result, the parts of the waist adjusting arrangements of the present invention will always be held relatively close to each other. This is desirable because it relieves the strains which can be applied to those waist adjusting arrangements during washing and cleaning procedures, and because those waist adjusting arrangements will be readily recognized, and can be handled, as integrated parts of the pair of trousers 20.

If desired, a female snap fastener could be mounted on the inner ply of the waistband 24 between the fastener 40 and the loop 32; and that female fastener would open toward the wearer of the pair of trousers. A male snap fastener, which could mate with that female fastener, could be mounted on the portion of the masking band 84 which is between the loop 32 and the reentrant bend in that masking band in FIG. 9; and that male fastener would confront that female fastener. That male and female fastener could be engaged to positively hold the reentrant bend of the masking band 84 immediately adjacent the inner face of waistband 24, and also to help cause the major portion of the length of that masking band to lie essentially flat against that inner face. Actually, however, it has been found that once the desired waist size has been provided for the pair of trousers 20 by appropriate interconnecting of the male and female fasteners at the left-hand and right-hand sides of that pair of trousers, and after the reentrant bends of the masking bands have been moved forwardly in the circumferential direction to smooth all portions of those masking bands, there is little or no shifting of either of those masking bands relative to the waistbands 24 and 74 or to the waistband 48 and the counterpart of waistband 74. All of this means that where a pair of trousers 20 has been supplied by a linen service, and a wearer has (a) properly set the waist size, (b) donned that pair of trousers, and (c) smoothed the masking bands, that wearer should be able to remove and re-don that pair of trousers repeatedly without having to use the reentrant bends in the masking bands to again smooth out those masking bands.

Figure 13:
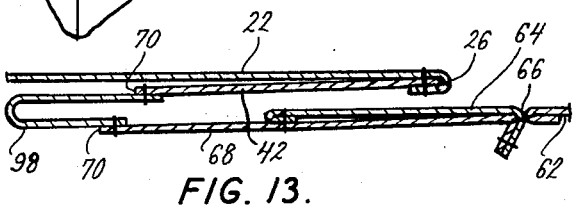
FIG. 13 is a sectional view, like that of FIG. 10, wherein a gusset fills the cut-away upper portion of the folded front edge of the right-hand pocket of the pair of trousers.

It will be noted that the cut away portion 70 of the upper part of the folded edge of the pocket in FIGS. 4, 7 and 10 is open. That fact will not make that pocket a less secure depository for objects; because that cut-away portion is so close to the waistbands 24 and 74. However, it has been noted that a wearer's thumb could extend through that cut-away portion. To enable the adjacent ends of waistbands 24 and 74, and the overlapping areas of the upper parts of panels 22 and 62, to move freely relative to each other, and yet keep a wearer's thumb from passing forwardly through the cut-away portion 70, a gusset 98 of ample proportions can be sewn to those parts of the pocket that are adjacent the cut-away portion 70. Such a gusset is shown in FIG. 13; and that gusset permits full and ready relative movement between the waistbands 24 and 74 and between the panels 22 and 62, and yet will keep a wearer's thumb from passing out of the pocket.

The drawing shows a waist adjusting arrangement at each side of the pair of trousers 20; and the use of two waist adjusting arrangements is desirable. Not only does the use of two waist adjusting arrangements make the appearances of the two sides identical, but it permits those sides to have the same dimensions after an adjustment has been made. However, if desired, a single waist adjusting arrangement could be provided for the pair of trousers. For purposes of symmetry, that waist adjusting arrangement could be located at the middle of the front, or at the middle of the rear, of the waistband for the pair of trousers.

The drawing shows the waist adjusting arrangement of the present invention incorporated into a pair of trousers. However, that waist adjusting arrangement is not limited to use with a pair of trousers. Instead, it can be used with skirts, culottes, shorts, trunks, and most other garments which have waistbands.

If desired, two female fasteners could be provided at the inner face of the vertical portion of each of the loops 28 and 32. Those two fasteners would be spaced apart vertically; and they would accomodate correspondingly-spaced pairs of male fasteners on the inner surface of the waistband 74 and of the masking band 84. However, in actual practice, it has been found that one female fastener per loop is sufficient.

If desired, the loop 32 could be dispensed with, and the waistband 74 could be secured to the waistband 24 by the loop 28, by the female fastener 30, and by one of the male fasteners 78, 80 and 82. However, it is desirable to use both loops 28 and 32 to provide full support for both the forward-most portion of waistband 74 and the rear-most portion of waistband 24.

If desired, a tunnel could be used to replace the loops 28 and 32. In such event, the female fasteners 30 and 34 would be secured to horizontally-spaced, vertically-directed portions of that tunnel. The masking band 84 would be passed through that tunnel before the ends of that masking band were secured to the waistband 74. Whether a tunnel, two loops, a single loop or any other structure is provided as a confining and guiding means for the masking band 84, the major portion of the length of that masking band will be held immediately adjacent, and in face-to-face relation with, the inner face of waistband 24 and in face-to-face relation with the outer face of waistband 74.

Importantly, only the rear portion of the masking band 84, and none of the snap fasteners, are visible from the exterior of the pair of trousers 20. Also importantly, the lapping areas of the upper parts of the panels 22 and 62 provide a smooth appearance in any adjusted waist size position of that pair of trousers. Moreover, the rear of the waistband 24 will always lap part of the waistband 74, and the rear of the upper part of the panel 22 will always lap part of the front of the extension 64 of the panel 62—regardless of the adjusted waist size position of the pair of trousers. Additionally, the waist adjusting arrangement permits all lapping portions of the waistbands 24 and 74 and all lapping portions of the panels 22 and 62 to be completely fold-free and to be free of gathers and puckers; and hence those lapping portions are able to assume the configuration of the wearer of the pair of trousers, and to be free of bulges due to the presence of folds, gathers or puckers.

The loop-like nature of the masking band 84 is very desirable; because it limits the extent to which the waistband 24 can be separated from the waistband 74, and vice versa. However, if desired, that masking band could be made as a stiff tongue or projection which was dimensioned to pass through the loops 28 and 32 and to continue on past the loop 32 toward the free edge 38 of that waistband. That stiff tongue would not need to be connected to the forward end of the waistband 74. In the maximum waist size position shown by FIG. 5, that tongue would be long enough to pass through the loop 32. In the minimum waist size position shown by FIG. 5, the forward end of that stiff tongue would pass through the loop 32 and extend toward, but terminate well short of, the end 38 of waistband 24.

The elongated reentrant bend, which is shown in the masking band 84 in FIG. 9, is desirable; because it can easily be sought out by a finger or thumb of the wearer, without requiring the wearer to pull the waistbands 24 and 74 away from his or her body. All the wearer need do is to insert a thumb or finger between the masking band 84 and the waistband 74, at a point which is forward of the loop 32, and that thumb or finger will automatically engage the reentrant bend of that masking band.

In the preferred embodiment of the present invention, the distance from the rear end of masking band 84 to the reentrant bend in that masking band is about ten and a half inches, the distance from the stitching 86 to the front end 76 of waistband 74 is about six and a quarter inches, and the distance from the rear edge 25 of waistband 24 to the forward end 38 of that waistband is about eight and a half inches. In the minimum waist size position shown by FIG. 5, the portion of the masking band 84 between the left-hand side of loop 32 and the reentrant bend is two and a half inches. In the maximum waist size position shown in FIG. 9, the distance from that side of that loop to that bend is less than one half of an inch. The waistband 24 laps the waistband 74 by about four inches in the maximum waist size position of FIG. 9, and it laps that waistband by about six inches in the minimum waist size position of FIG. 5.

If desired, hooks and eyes, buttons and button holes, hook and pad sections of Velcro, or other readily engaged and readily separated fasteners could be used instead of male and female snap fasteners. However, it has been found that male and female snap fasteners are relatively inexpensive, relatively easy to apply, and relatively trouble-free.

Whereas the drawing and accompanying description have shown and described a preferred embodiment of the present invention, it should be apparent that various changes can be made in the form of the invention without changing the scope thereof.

What we claim is:

1. A garment with a readily adjustable waist size which comprises a plurality of sections that coact to define at least a part of said garment, one of said sections having an area of the upper part thereof disposed inwardly of and in register with and movable relative to an area of the upper part of the other of said sections, a first securing means and a complementary securing means that are engageable to hold said area of said upper part of said one section in register with said area of said upper part of said other section, said first securing means and said complementary securing means being engageable in different positions relative to each other to help determine the size of the waist of said garment by determining the amount of said area of said upper part of said one section which is in register with said area of said upper part of said other section, said first securing means appearing at the outer face of said area of said upper part of said one section, said complementary securing means and said area of said upper part of said other section overlying and concealing at least part of said first securing means when said garment is given its minimum waist size, and a masking means that overlies and conceals any part of said first securing means which may not be overlain by said area of said upper part of said other section when said garment is given its maximum waist size, at least a part of said masking means being disposed inwardly of and being concealed by said area of said upper part of said other section.

2. A garment as claimed in claim 1 wherein said masking means has one end thereof secured adjacent an edge of said area of said upper part of said one section, wherein said masking means extends outwardly beyond said edge of said area of said upper part of said one section, wherein said masking means has a reentrant bend therein to help define said part which is disposed inwardly of and is concealed by said area of said upper part of said other section, and wherein the other end of said masking band is secured to a portion of the outer face of said one section which is displaced from said area of said upper part of said other section.

3. A garment as claimed in claim 1 wherein said area of said upper part of said other section has a confining and guiding means at the inner face thereof, and wherein said part of said masking means which is disposed inwardly of and is concealed by said area of said upper part of said other section is held by said confining and guiding means.

4. A garment as claimed in claim 1 wherein said area of said upper part of said other section has a confining and guiding means at the inner face thereof, wherein said part of said masking means which is disposed outwardly of and is concealed by said area of said upper part of said other section is held by said confining and guiding means, wherein said masking means extends in one direction from said confining and guiding means to be secured to said one section, and wherein said masking means extends in the opposite direction from said confining and guiding means but has a reentrant bend therein to be secured to said one section.

5. A garment as claimed in claim 1 wherein confining and guiding means at the inner face of said area of said upper part of said other section includes a plurality of loops, and wherein said part of said masking means which is disposed inwardly of and is concealed by said area of said upper part of said other section is confined and guided by said loops.

6. A garment as claimed in claim 1 wherein a laterally-yieldable means at the inner face of said area of said upper part of said other section supports said complementary securing means, and wherein said laterally-yieldable means can yield laterally to permit said complementary securing means to move laterally and thereby provide automatic limited expandability of the waist of said garment while said garment is being worn.

7. A garment as claimed in claim 1 wherein laterally-yieldable means at the inner face of said area of said upper part of said other section supports said complementary securing means, wherein said laterally-yieldable means can yield laterally to permit said complementary securing means to move laterally and thereby provide automatic limited expandability of the waist of said garment while said garment is being worn, and wherein said laterally-yieldable means also confines and guides said part of said masking band which is disposed inwardly of and is concealed by said area of said upper part of said other section.

8. A garment as claimed in claim 1 wherein said masking means is a band which is parallel to, and which appears to be an extension of, a waistband at the outer face of said upper part of said one section.

9. A garment as claimed in claim 1 wherein said masking means is a band which is parallel to, and which appears to merge into a waistband at the outer face of said upper part of said other section.

10. A garment as claimed in claim 1 wherein said area of said upper part of said other section has a confining and guiding means that holds said part of said masking means in face-to-face engagement with, while permitting sliding movement of said part of said masking means relative to, the inner face of said area of said upper part of said other section.

11. A garment as claimed in claim 1 wherein said area of said upper part of said other section has a confining and guiding means that supports said complementary securing means.

12. A garment as claimed in claim 1 wherein at least a part of said first securing means is carried by said masking means.

13. A garment as claimed in claim 1 wherein said one section has an external waistband, and wherein said masking means is a band that approximates the size and shape of said external waistband on said one section.

14. A garment as claimed in claim 1 wherein said one section has an external waistband, wherein said other section has an external waistband of substantially the same size and shape, and wherein said masking means is a band that approximates the size and shape of said external waistband on said one section, whereby said masking means appears to be an integral part of said external waistbands.

15. A garment as claimed in claim 1 wherein said area of said upper part of said other section has a confining and guiding means at the inner face thereof, wherein said masking means has a reentrant bend therein, and wherein said part of said masking means can be caused to lie in face-to-face, fold-free and gather-free engagement with said inner face of said area of said upper part of said other section by applying a circumferentially-directed force to said reentrant bend.

16. A garment as claimed in claim 1 wherein confining and guiding means at the inner face of said area of said upper part of said other section includes a plurality of loops, wherein said part of said masking means which is disposed inwardly of and is concealed by said area of said upper part of said other section is confined and guided by said loops, wherein said masking means has a reentrant bend therein, wherein said reentrant bend is close to one of said loops whenever said garment has its largest waist size, and wherein said reentrant bend is spaced away from said one loop whenever said garment has its smallest waist size.

17. A garment as claimed in claim 1 wherein said one section forms one side of the entrance, plus a portion of the inner wall, of a pocket in said garment, and wherein said other section forms the other side of said entrance of said pocket.

18. A garment as claimed in claim 1 wherein confining and guiding means at the inner face of said area of said upper part of said other section includes a plurality of loops, wherein said part of said masking means which is disposed inwardly of and is concealed by said area of said upper part of said other section is confined and guided by said loops, wherein said loops have vertical portions, and wherein said complementary securing means are carried by the inner faces of said vertical portions of said loops.

19. A garment with a readily adjustable waist size which comprises a plurality of sections that coact to define at least a part of said garment, one of said sections having an area of the upper part thereof disposed inwardly of and in register with and movable relative to an area of the upper part of the other of said sections, a first securing means that moves with, and that is exposed at the outer face of, said area of said upper part of said one section, complementary securing means that moves with, and that is exposed at the inner face of, said area of said upper part of said other section, said first securing means and said complementary securing means being engageable to hold said area of said upper part of said one section in register with said area of said upper part of said other section, said first securing means and said complementary securing means being engageable in different positions relative to each other to help determine the size of the waist of said garment by determining the amount of said area of said upper part of said one section which is in register with said area of said upper part of said other section, and a masking means that is adapted to overlie and conceal part of said first securing means when said garment is given its maximum waist size, said masking means having a portion thereof disposed inwardly of and concealed by said area of said upper part of said other section.

20. A garment as claimed in claim 19 wherein said portion of said masking means which is disposed inwardly of and is concealed by said area of said upper part of said other section is held in face-to-face engagement with the inner face of said area of said upper part of said other section.

21. A garment as claimed in claim 19 wherein said portion of said masking means which is disposed inwardly of and is concealed by said area of said upper part of said other section is intermediate said complementary securing means and the inner face of said area of said upper part of said other section.

22. A garment as claimed in claim 19 wherein said masking means has a reentrant bend beyond said portion which is disposed inwardly of and concealed by said area of said upper part of said other section, and wherein both ends of said masking means are secured to said upper part of said one section.

23. A garment as claimed in claim 19 wherein said masking means defines a loop which has both ends thereof secured to said upper part of said one section, wherein said portion of said masking means which is disposed inwardly of and is concealed by said area of said upper part of said other section is spaced from both ends of said loop, and wherein said portion of said masking means which is disposed inwardly of and concealed by said area of said upper part of said other section is intermediate said complementary securing means and the inner face of said other section.

24. A garment as claimed in claim 19 wherein one end of said masking means is secured to the outer face of said area of said upper part of said one section, and wherein said masking means extends toward said area of said upper part of said other section to mask any otherwise-exposed portion of said first securing means.

25. A garment as claimed in claim 19 wherein said masking means is a band which is secured to the outer face of said area of said upper part of said one section to appear to be an extension of a waistband on said upper part of said one section, and wherein said masking means appears to merge into a waistband on said upper part of said other section.

26. A garment as claimed in claim 19 wherein at least part of said complementary securing means is carried by said masking means.

27. A garment as claimed in claim 19 wherein said one section forms one side of the entrance, plus a portion of the inner wall, of a pocket in said garment, wherein a portion of the front of said pocket is cut-away, and wherein a gusset fills said cut-away portion of the front of said pocket.

28. A garment with a readily adjustable waist size which comprises a plurality of sections that coact to define at least a part of said garment, one of said sections having an area of the upper part thereof disposed inwardly of and in register with and movable relative to an area of the upper part of the other of said sections, a first securing means that moves with, and that is exposed at the outer face of, said area of said upper part of said one section, complementary securing means that moves with, and that is exposed at the inner face of, said area of said upper part of said other section, said first securing means and said complementary securing means being engageable in different positions relative to each other to help determine the size of the waist of said garment by determining the amount of said area of said upper part of said one section which is in register with said area of said upper part of said other section, said upper part of said one section and said upper part of said other section moving in face-to-face relation and without any folding of either of them to adjust the size of the waist of said garment, and a masking means that overlies and conceals any part of said first securing means which may not be concealed by said upper part of said other section.

29. A garment as claimed in claim 28 wherein said masking means engages said upper part of said one section and said upper part of said other section to limit relative separating movement of said upper parts of said sections.

* * * * *